US005524020A

United States Patent [19]

Jhawar et al.

[11] Patent Number: 5,524,020

[45] Date of Patent: Jun. 4, 1996

[54] VACUUM FURNACE WITH MOVABLE HOT ZONE

[75] Inventors: Suresh C. Jhawar, Anaheim Hills; John K. Grier, Walnut; Brian K. Grier, Chino Hills; Ardishir Rashidi, Upland, all of Calif.

[73] Assignee: Grier-Jhawar-Mercer, Inc., Walnut, Calif.

[21] Appl. No.: 294,448

[22] Filed: Aug. 23, 1994

[51] Int. Cl.[6] ..... F27D 7/06

[52] U.S. Cl. ..... 373/110; 373/111; 266/250; 219/400; 432/121

[58] Field of Search ..... 266/250, 251, 266/259; 432/121, 205, 250; 148/633, 660; 373/110, 113, 130; 219/400, 390, 408, 532

[56] References Cited

U.S. PATENT DOCUMENTS

| | | | |
|---|---|---|---|
| 3,438,618 | 4/1969 | Seelandt | 266/250 |
| 3,718,324 | 2/1973 | Westeren et al. | 266/250 |
| 3,847,539 | 11/1974 | Kreider et al. | 432/121 |
| 3,879,165 | 4/1975 | Krieder et al. | 432/121 |
| 4,559,631 | 12/1985 | Moller | 373/130 |
| 4,647,017 | 3/1987 | Stainbrook | 266/89 |
| 4,771,166 | 9/1988 | McGuire et al. | 219/532 |
| 4,867,808 | 9/1989 | Heilmann | 148/633 |
| 5,059,757 | 10/1991 | Law et al. | 373/114 |
| 5,121,903 | 6/1992 | Ripley et al. | 266/250 |
| 5,267,257 | 11/1993 | Jhawar et al. | 373/110 |

FOREIGN PATENT DOCUMENTS

| | | |
|---|---|---|
| 645716 | 7/1964 | Belgium . |
| 2102693 | 12/1971 | Germany . |
| 850157 | 9/1960 | United Kingdom . |
| 1012195 | 12/1965 | United Kingdom . |
| 1085360 | 9/1967 | United Kingdom . |

OTHER PUBLICATIONS

M. Kalbfleisch, "Fours de brasage et de traitment thermique sous vide", p. 87, left column; FIG. 1, Mar. 1972, Vide, Les Couches Minces, No. 158.

F. Limque et al., "Erfahrungen mit Uberdruck–Gasabschrecken sowie Aufkohlen in Vakuumbfen", May 1980, pp. 238–244, Haerterei Technische Mitteilungen, vol. 35, No. 5, Munchen DE.

*Primary Examiner*—Tu Hoang
*Attorney, Agent, or Firm*—Christie, Parker & Hale

[57] ABSTRACT

A high temperature vacuum heat treating furnace has a hot zone, including heating elements and thermal insulation, which is movable between a heating location at least partly surrounding a load space and a cooling location remote from the load space. A cooling gas plenum around the hot zone in the heating location can eject cooling gas toward a load in the load space after the hot zone is retracted. Cooling rates approximately comparable to a furnace operable at four bar pressure can thereby be obtained in a furnace rated for no more than two bar internal pressure.

27 Claims, 6 Drawing Sheets

VACUUM FURNACE WITH MOVABLE HOT ZONE

BACKGROUND

This invention relates to a vacuum or protective atmosphere heat treating furnace which permits very rapid cooling of a load in the hot zone.

Vacuum furnaces are well-known in the art. It is often desirable to heat treat metal parts, particularly, steel parts, in a vacuum. The vacuum provides protection for the parts, the surfaces of which may react with and be contaminated by atmospheric gases at high temperatures. The vacuum also protects electric heating elements in the furnace. Additionally, the use of a vacuum at high temperatures reduces heat losses and thus heating costs.

To obtain the desired properties of the metal, referred to herein as a load, it is often necessary to quench the load to rapidly reduce its temperature. When parts are heated in air this may be done by quenching in water, oil or molten salt.

Alternatively, when heated in a vacuum furnace, the load may be moved from a vacuum chamber to a separate chamber which holds the quenching medium. However, when a load of steel parts is heated above about 1200° C., movement of the load from the hot zone of the furnace to a separate quenching zone can easily deform the parts.

Another technique is to quench the parts with a blast of cold inert gas introduced into a vacuum furnace at the end of the heating cycle. This, however, may result in insufficient quenching due to the necessity to cool parts of the furnace in addition to the load, such as the heating elements, insulation and other structural elements which comprise a hot zone of the furnace.

A technique for avoiding insufficient quenching in a vacuum furnace is to remove the load from the hot zone prior to gas quenching. This may be done by building a vacuum vessel with two interconnected chambers. The hot zone is located in the first chamber and the load is heated in this chamber. After heating, the load is moved into a second chamber adjacent to the first and the door between the two chambers is closed. The load is then gas quenched in this second chamber. Some alloys, however, required heating temperatures near the melting point of the metal, which significantly reduces the strength of the parts. The movement of the load from one chamber to another under these conditions may deform the metal parts. It is, therefore, desirable to provide a technique for rapidly gas quenching a load without first moving it out of the hot zone.

The rate of cooling obtained during a gas quench is a function of the pressure of the gas as well as its flow velocity. To avoid insufficient quenching, vacuum furnaces have been built which can withstand superatmospheric pressure. A typical vacuum furnace can operate at absolute pressure of up to two atmospheres to permit quenching the steel parts with a higher pressure of gas.

Vacuum heat treating furnaces have also been designed for operation at absolute pressures of from five to ten atmospheres to get even more rapid cooling without moving the load. Such furnaces may be able to harden a two-inch steel part, as compared with hardening a one-inch steel part in a furnace that operates at pressures up to two bar absolute.

A vacuum furnace can readily be built to withstand a pressure of two atmospheres; that is, one atmosphere pressure above ambient atmospheric pressure. Such a furnace is often referred to as a two-bar furnace. The same construction techniques may be used for a two-bar furnace, as for a vacuum furnace that is not repressurized above atmospheric pressure. However, if a furnace is to be built for an internal pressure higher than two bars, it must be constructed, inspected and certified under the ASME boiler codes, which can significantly increase the manufacturing cost of the vacuum vessel.

It is, therefore, desirable to provide a vacuum heat treating furnace with a cooling rate greater than a two-bar furnace without increasing the rating of the furnace shell above two bar.

BRIEF SUMMARY OF THE INVENTION

There is, therefore, provided in practice of this invention according to a presently preferred embodiment a heat treating furnace with a vacuum vessel and means for evacuating the vessel. A load such as metal parts to be heat treated, is supported in a load space within a hot zone inside the vessel. Such a hot zone may comprise electrical heating elements, thermal insulation and supporting structure. A cooling gas plenum surrounds at least a portion of the hot zone. Means are provided for retracting the hot zone from between the load space and the plenum after the load has been heated to elevated temperature. Cooling gas is then circulated from the gas plenum toward the load space for cooling a load therein. Retracting the hot zone permits rapid gas quenching of the load with a higher effective cooling rate than the pressure rating of the vacuum vessel would indicate.

BRIEF DESCRIPTION OF THE DRAWINGS

These and other features and advantages of the present invention will be appreciated as the same become better understood by reference to the following detailed description when considered in conjunction with the drawings in which.

DETAILED DESCRIPTION

Figure 1:
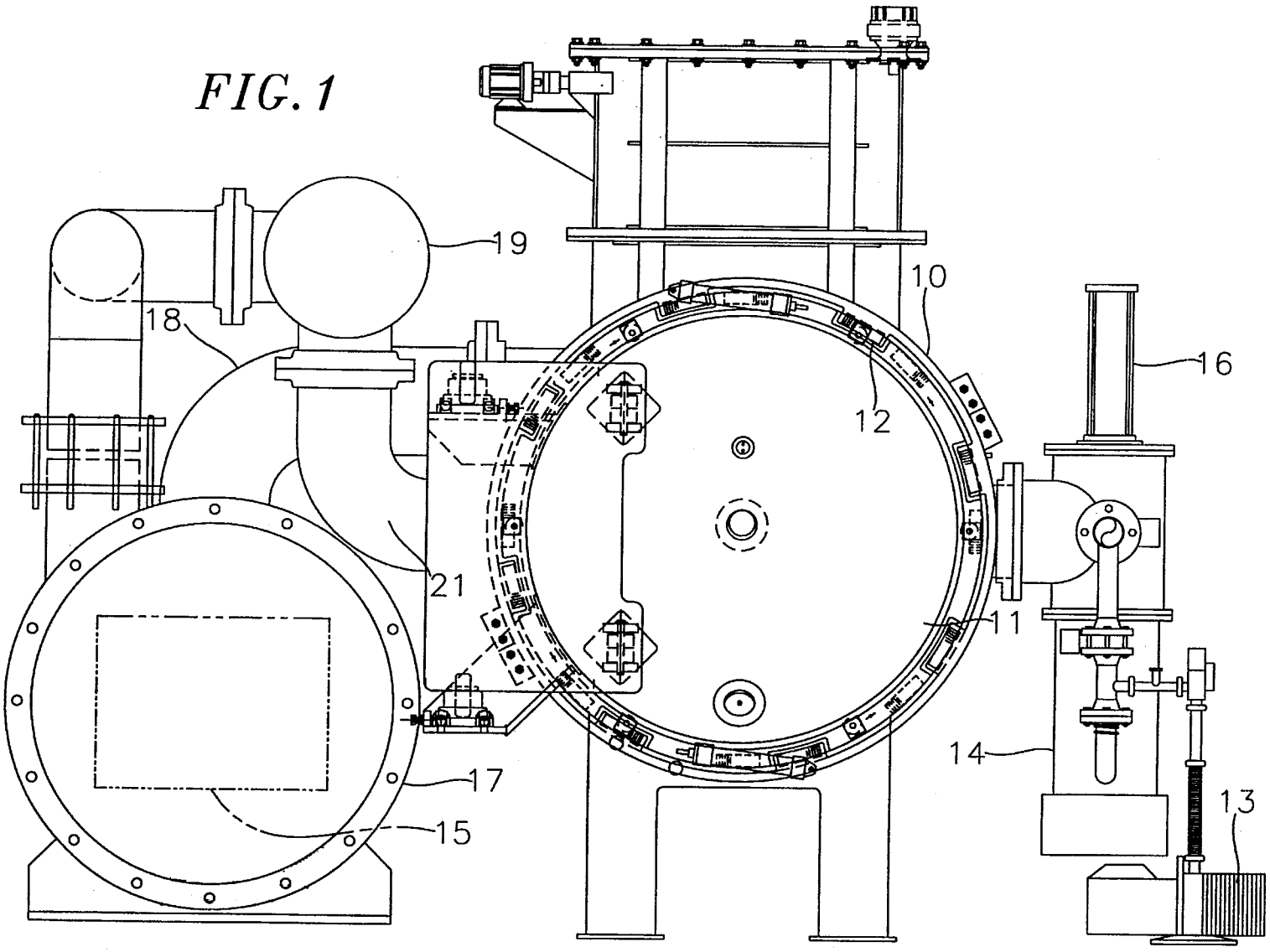
FIG. 1 is an end view of a vacuum furnace constructed according to principles of this invention.

The vacuum heat treating furnace comprises a generally cylindrical vacuum vessel or shell 10 having double walls between which cooling water can be circulated for keeping the furnace shell cool. A water cooled, full size bulkhead door 11 is pivotably mounted at one end of the shell. When closed the door seals against the end of the furnace shell and is clamped in place by a conventional rotating clamp ring 12. As an aside, it may be noted that with the arrangement provided in practice of this invention, it is not necessary to have a costly door at each end of the cylindrical shell, although a second door may be used at the back of the shell, if desired.

Conventional mechanical vacuum pumps 13, one of which is illustrated, and a diffusion pump 14 are connected to the shell for rapid evacuation. A pneumatically operated vacuum valve 16 may be used to isolate the hot diffusion pump when vacuum is to be broken. This permits rapid gas cooling of a load without damage to the pumping system and facilitates rapid pump down of the furnace after it is reloaded.

A cooling gas handling system is located on the opposite side of the furnace shell from the evacuation system. This includes a conventional heat exchanger 15 and gas blower 17 connected to the furnace shell by a gas return line (pipe) 18. (The cylindrical shell of the heat exchanger is hidden by the housing of the blower in the end view of FIG. 1) Gas from the blower is circulated through a post cooler 19 and back into the furnace shell through a gas inlet line 21.

Other conventional accessory equipment is also external to the vacuum furnace shell and is not described or illustrated herein. For example, temperature and pressure control instrumentation, measuring devices, material handling apparatus, cylinders for cooling gasses and the like may be on or near the furnace.

A plurality of vertical support columns 22 are welded inside the furnace shell for supporting a load 23 which is illustrated schematically in a load space near the front or openable end of the furnace shell. A load of metal parts to be heat treated, for example, can be set into the load space through the open door (not illustrated in FIGS. 2 and 3) by a forklift or the like.

Surrounding three sides of the load space is a hot zone 25, this term being used herein to designate a portion of the furnace structure, rather than simply a heated location in the furnace. The heated location is somewhat generally referred to as the load space. In this furnace the "hot zone" comprises a generally U-shaped rectangular steel frame 24. Thermal insulation 26 is mounted inside the steel frame on a plurality of inwardly projecting pins. The back of the hot zone (i.e., the face away from the furnace door) is also insulated. Suitable thermal insulation may comprise fibrous carbon batts and/or sheet metal radiation shields.

Hanging electrical heating elements 27 are on either side of the load space inside the thermal insulation. In the illustrated embodiment, the heating elements are graphite and it will be apparent that metal heating elements may be employed, if desirable. For reasons that will be apparent, graphite is desirable since its strength and resistance to damage increase at elevated temperature. The heater elements are suitably electrically connected by heating element connectors 28 at top and bottom. Power connections 29 on the frame 24 provide electrical power for the heating elements. Such features of the hot zone are essentially conventional although they may differ somewhat from conventional structure so that the hot zone can be movable in practice of this invention.

The hot zone is mounted on a plurality of transfer wheels 31 along each bottom edge. The wheels roll in U-shaped tracks 32 which guide the hot zone along the length of the shell and help prevent thermal warping of the hot zone as it is heated and cooled.

Figure 2:
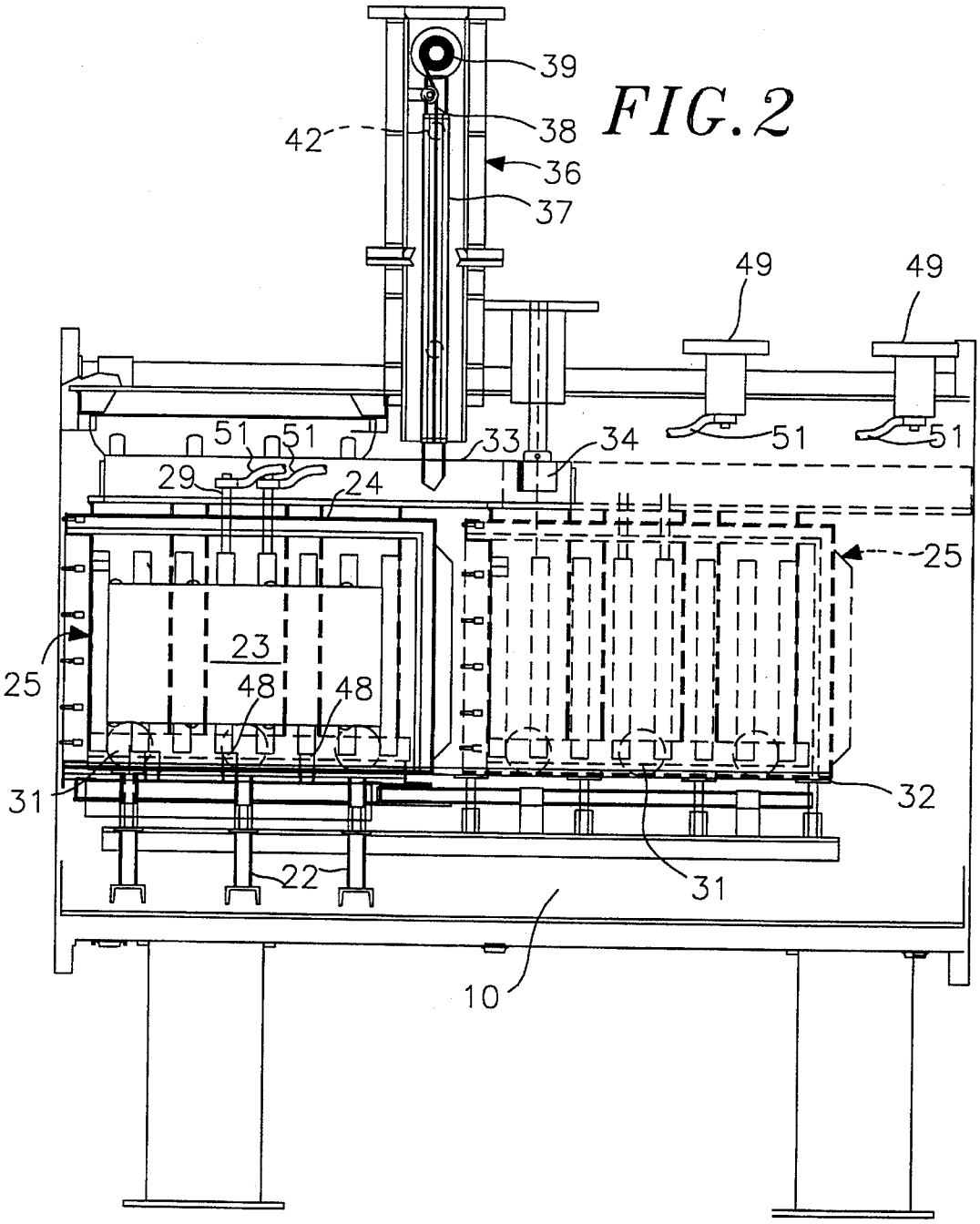
FIG. 2 is a longitudinal cross section through the vacuum furnace.

The hot zone is movable between a heating location at least partly surrounding the load space as illustrated at the left side of FIG. 2 and a cooling location illustrated in phantom toward the right side of FIG. 2. Generally speaking, the hot zone is located in its cooling position toward the back of the furnace while the load is being put into the furnace or removed. This leaves the equipment operator very little opportunity to damage the heating elements while the load is being moved.

After the load is in its proper position in the load space, the hot zone is moved from its retracted cooling position to its heating position around the load space. In a typical operating cycle, the door is then closed, the vacuum system evacuates the furnace and electrical power is applied to the heating elements for heating the load. When the load has reached equilibrium at its desired temperature, the hot zone is retracted from the heating location to the cooling location, cooling gas is introduced to the vacuum vessel and the load is gas quenched, as described in greater detail hereinafter. After the load and hot zone have reached a suitably low temperature, the shell is brought back down to atmospheric pressure, the door is opened and the load may be removed.

In the illustrated embodiment, the hot zone is moved between the heating and cooling locations by a rack secured along the top of the frame 24. A motor driven pinion gear 34 drives the rack for moving the hot zone. The teeth on the rack and pinion are vertical so that there is no binding due to thermal expansion. Other arrangements for moving the hot zone will be apparent, such as for example, a pneumatic actuator, a continuous chain drive on sprockets or other equivalent mechanical arrangements.

A generally rectangular hood assembly 36 extends above approximately the middle of the furnace shell. A roughly square gate 37 hangs on cables 38 inside the hood. The cables are wrapped around drums 39 on a shaft 41 which can be rotated for raising or lowering the gate. The gate has wheels 42 along each side edge which are within vertical guides 43.

Figure 3:
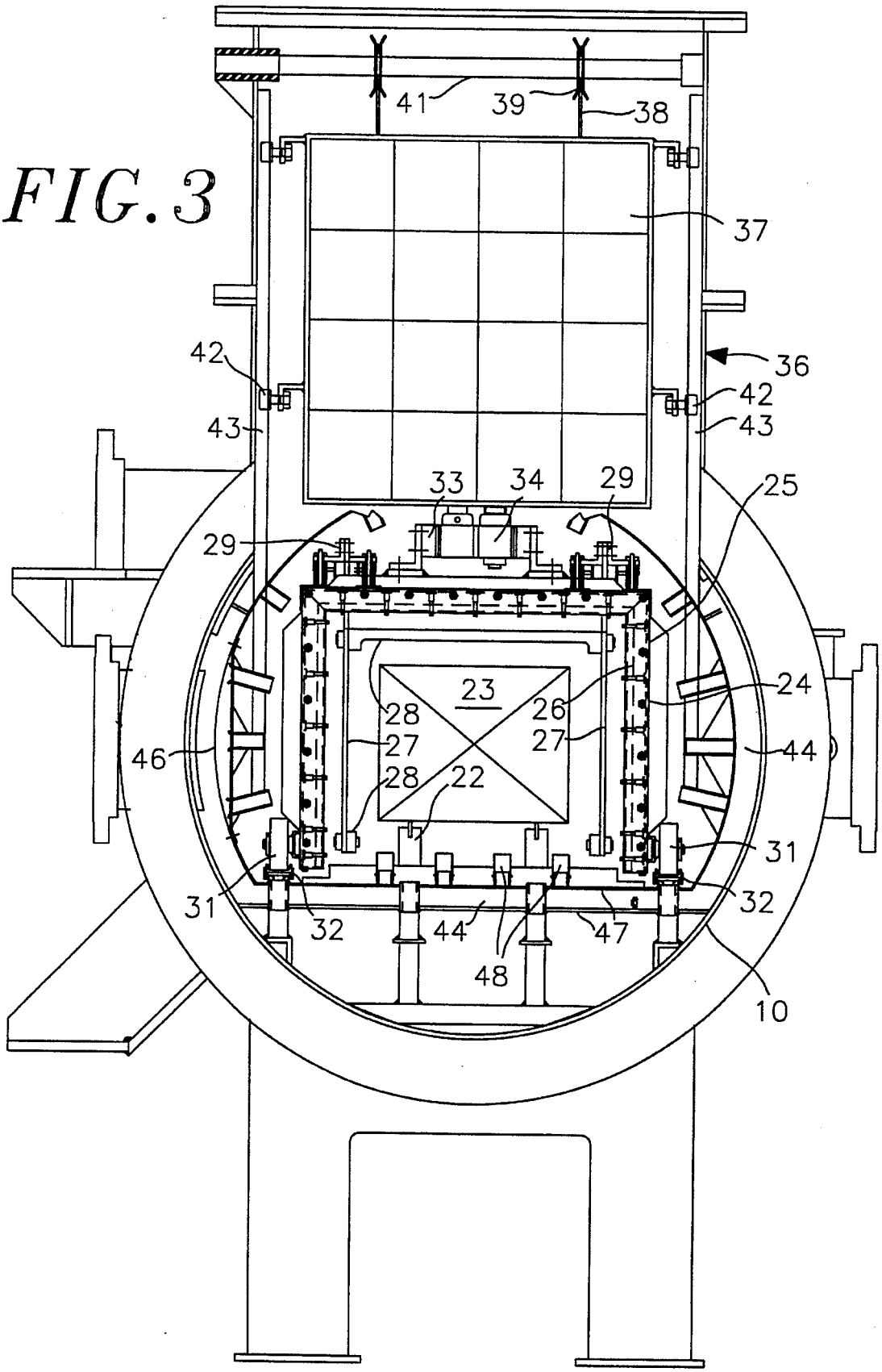
FIG. 3 is a transverse cross section through the vacuum furnace.

A cooling gas plenum 44, as illustrated in FIG. 3, largely surrounds the load space outside of the hot zone. Around the cylindrical inside of the furnace shell at each side of the hot zone, the cooling gas plenum is formed by a curved sheet 46 concentric with the shell. Along the bottom of the load space, the cooling gas plenum may be parallel horizontal sheets 47. A plurality of cooling gas nozzles 48 extend from the plenum toward the load space for ejecting cooling gas toward the load.

The cooling gas inlet 21 connects the external cooling system to the inside of the cooling gas plenum. The gas return line at 18, on the other hand, is connected through the furnace shell near the back or closed end of the shell adjacent to the cooling location for the hot zone.

At the end of the heating cycle, the hot zone is retracted to its cooling position. The gate 37 is then lowered into a position between the hot zone and the load space. The gate includes thermal insulation for isolating the hot zone from the load in the load space. Holes (not shown) through the gate permit gas flow through the gate. Gas may also flow around the gate. Inert cooling gas, such as helium or nitrogen, is introduced the furnace to a desired internal pressure, for example, up to two bars absolute in a furnace shell which is not rated for higher pressures.

The blower causes a blast of cooling gas to be ejected from the nozzles toward the load in the load space for rapidly extracting heat. The gas then flows through and around the gate and through and around the hot zone before exiting from the furnace shell through the return line. The gas then passes through the heat exchanger to the blower inlet, through the post cooler and back into the cooling gas plenum. The post cooler is used for withdrawing heat added to the cooling gas by the blower and facilitates rapid cooling of the load. Some cooling of the gas also occurs during flow through the portion of the plenum adjacent the water cooled walls of the vacuum vessel.

With this flow arrangement, the cooling gas is at its coolest when ejected from the plenum nozzles toward the load. Since the hot zone has been retracted, the cooling gas can effect rapid cooling of the load without also having to cool the heating elements and thermal insulation of the hot zone. The cooling gas does, however, pass through and around the hot zone after its primary cooling mission, and thereby extracts heat from the hot zone for bringing it down to a temperature where the furnace shell can be safely opened.

Since the hot zone has been retracted from the load space and need not be cooled simultaneously with the load, the cooling rate for the load can be appreciably higher than in a conventional vacuum furnace where the hot zone remains in place. For example, a two-bar vacuum heat treating furnace constructed according to principles of this invention can achieve cooling rates almost as high as a conventional vacuum furnace employing four-bar cooling.

It will be apparent that reference to a two-bar furnace is merely exemplary. This is a preferred arrangement since a two-bar furnace can be built and operated without special inspection and certification under boiler codes. If desired, however, the furnace shell may be fabricated to operate as a four-bar or higher pressure furnace. It turns out that the cooling rates achievable in higher pressure furnaces constructed according to principles of this invention can have cooling rates almost twice as high as a conventional furnace without a movable hot zone when operated at the same pressure. It will be apparent that the improvement achieved is somewhat dependent on the load. A light load with relatively lower stored heat is more effectively cooled than a more massive load with larger amount of stored heat.

In an exemplary furnace, the hot zone moves about 1.5 meters between the heating and cooling locations. This travel can be accomplished in about ten seconds. Typically, it takes five to ten seconds to fill the furnace and cooling gas circulation system with inert cooling gas. Thus, cooling of the load can commence rather quickly and since the gas need not cool the hot zone structure simultaneously with the load, faster cooling rates and deeper hardening of steel can be obtained.

Another feature required in the vacuum furnace with a movable hot zone is a way of conducting electric power between feedthrough ports 49 through the furnace shell and the power connections 29 on the movable hot zone. One straightforward way of doing this is to simply provide flexible electrical cables 51 which extend between the power ports though the shell and the power connections on the hot zone. Such cables are laid in troughs (not illustrated) above the hot zone location so that they do not sag into the hot zone when it is withdrawn toward its cooling location.

If desired, the power connections can be placed on the sides of the hot zone frame and flexible cables can be routed so as to hang down on either side of the hot zone. In either of these locations, the flexible cables can be kept cool enough that conventional high temperature electrical insulation is satisfactory. Alternatively, ceramic or high temperature plastic rings or "bangles" can be strung on the flexible cables to provide electrical insulation.

Figure 6:
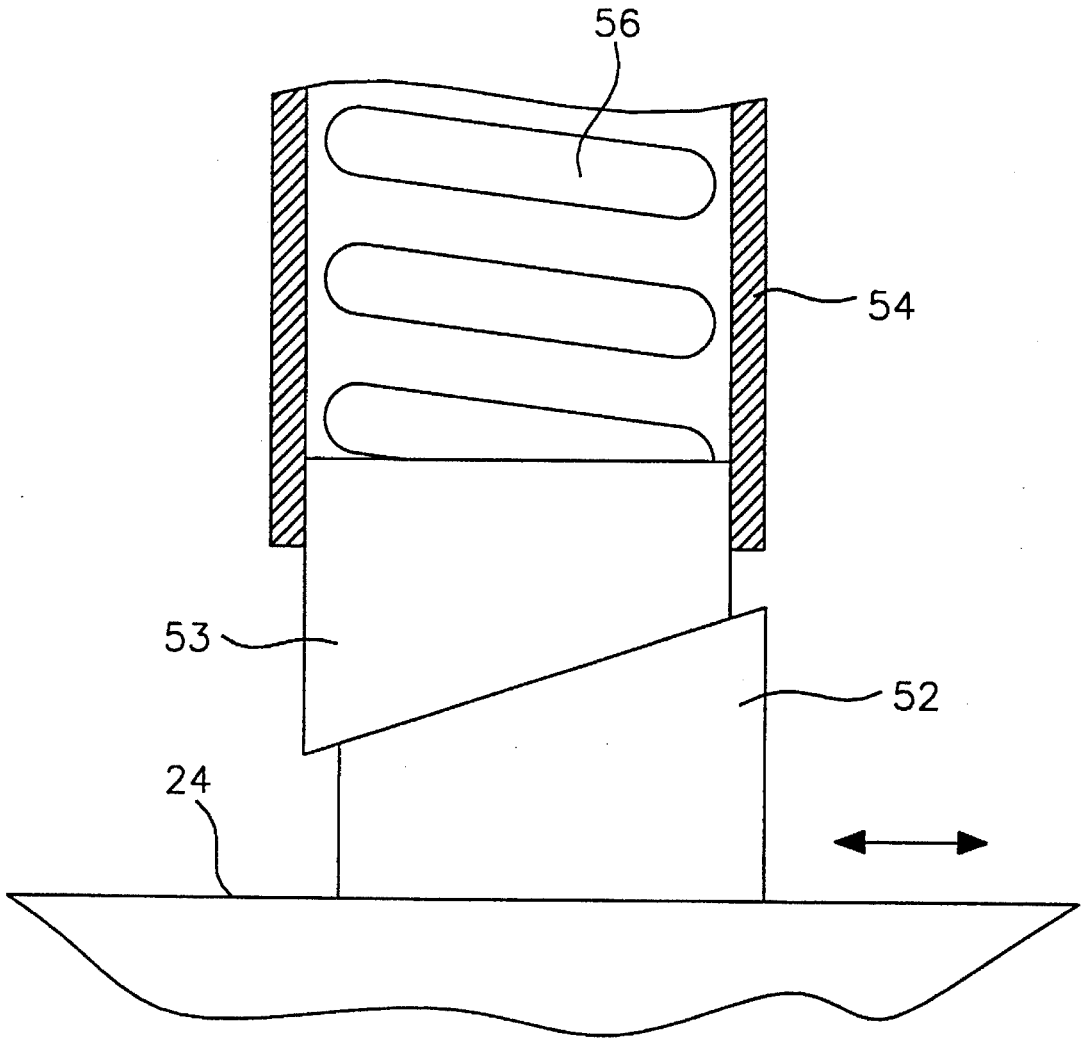
FIG. 6 is a fragmentary view of means for bringing electric power to the hot zone of the furnace.

An alternative power arrangement as illustrated in FIG. 6 is, in effect, a switch. A copper block 52 on the hot zone frame engages a copper block 53 mounted in a guidance sheath 54 in the furnace shell. The outer block 53 is electrically connected to the power feedthrough ports. A spring 56 on the outer block forces good engagement between the two cooper blocks. Such copper blocks engage when the hot zone is moved to its heating position surrounded the load space. They disconnect when the hot zone is retracted toward its cooling location.

Figure 4:
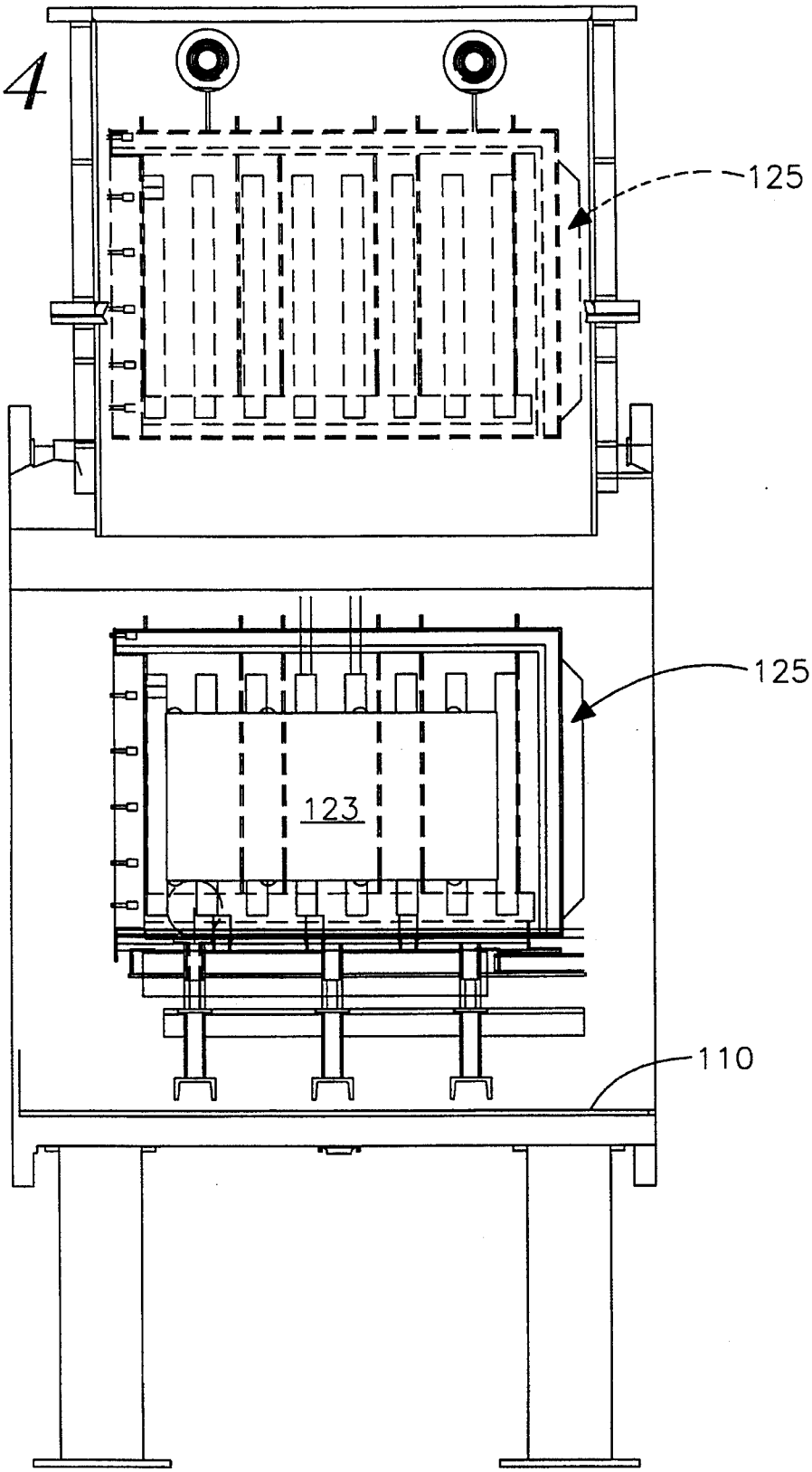
FIG. 4 is a longitudinal cross section through a portion of a second embodiment of vacuum furnace.
Figure 5:
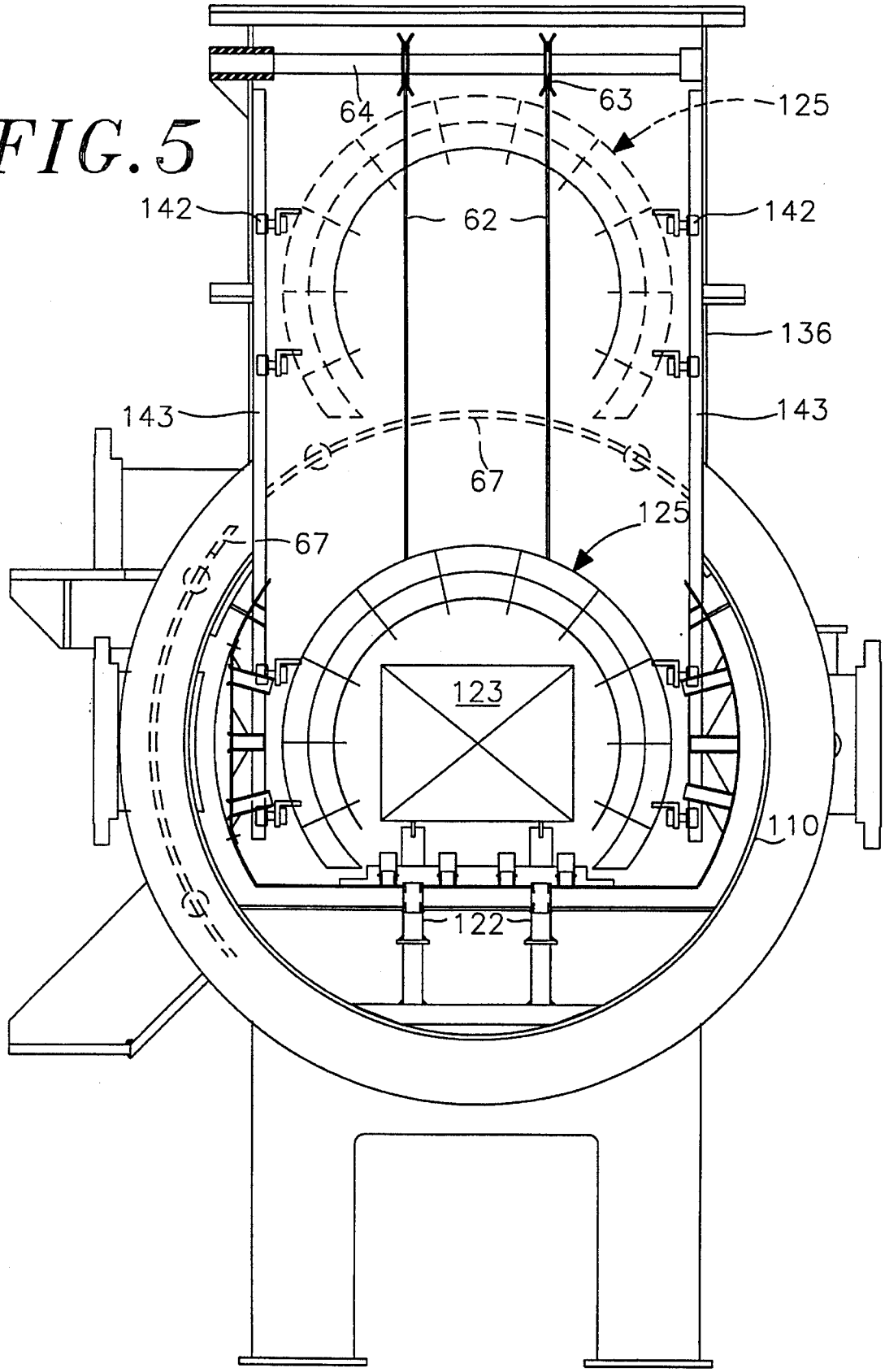
FIG. 5 is a transverse cross section through the second embodiment of vacuum furnace.

FIGS. 4 and 5 illustrate a second embodiment of vacuum heat treating furnace with a movable hot zone. Whereas in the embodiment illustrated in FIGS. 1, 2 and 3 the hot zone moved horizontally between the heating and cooling locations, the embodiment illustrated in FIGS. 5 and 6 has a hot zone that moves vertically between heating and cooling positions. In the illustrations of this embodiment, portions common to both embodiments are indicated with reference numerals 100 larger than the reference numerals in the first embodiment. Thus, for example, the furnace shell in the first embodiment is indicated in the drawings with reference numeral 10 and in the second embodiment the shell is indicated with reference numeral 110. Only a portion of this embodiment is illustrated and portions are shown schematically since this is sufficient for a complete understanding of the invention.

In this second embodiment, the hot zone 125 is approximately cylindrical instead of rectangular. This construction is convenient for use of molybdenum sheet heating elements. The hot zone is illustrated only schematically and it will be understood that it includes a suitable frame and thermal insulation differing somewhat in geometry from the corresponding structure of the embodiment with a rectangular hot zone.

A load 123 is received in a load space in a lower portion of the furnace shell 110 which is a cylindrical shell. The shell may have door (not shown) at one or both ends to facilitate loading and unloading. When the hot zone 60 is in its heating location, it largely surrounds the load space. The hot zone is connected to cables 62 which are wound around drums 63 mounted on a rotatable shaft 64 near the top of a large hood assembly 136 extending upwardly from the furnace shell. The hood in this embodiment may be a cylinder welded to the cylindrical shell of the furnace. Vertical guide tracks 143 receive wheels 142 mounted on the hot zone for guiding the hot zone between a lowered heating location illustrated in solid in the drawings to elevated cooling location illustrated in phantom in the drawings.

An arcuate gate 67 is inside the furnace shell beside the load space when the hot zone is in its heating position. After the hot zone is retracted to its elevated cooling position, the arcuate gate 67 is rotated to a position between the heating and cooling locations, as illustrated in phantom in FIG. 5. The gate provides a thermal barrier between the load as it cools and the hot zone.

An advantage of a vacuum heat treat furnace with a vertically movable hot zone can be that it has a smaller footprint than a furnace with a horizontally movable hot zone. The vertical moving furnace requires no more head room than the horizontal furnace since the horizontal furnace also has a hood assembly to accommodate the vertically movable gate. It will also be noted that, if desired, a furnace with a vertically movable hot zone may be constructed as a bottom loading furnace, instead of a side loading furnace.

Although only two embodiments have vacuum heat treating furnace constructed according to principles of this invention have been described and illustrated herein, it will be apparent that many additional modifications and variations may be employed. For example, instead of the simple gravity and cable arrangements for lowering and raising the gate or hot zone, pneumatic actuators, chain drives or the like could easily be substituted.

When using a horizontally movable hot zone, a generally E-shaped bottom of thermal insulation may be provided on the lower part of the hot zone. Slots in the E-shaped bottom panel of the hot zone provide clearance for the columns that support a load in the load space. Heat losses from the bottom of the hot zone may thereby be minimized. When there is such a bottom panel bridging between the sides of the hot zone, it may be convenient to employ tracks and wheels near the top of the hot zone instead of the bottom. Similarly, in an arrangement as illustrated in FIGS. 5 and 6, both ends of the cylindrical hot zone may be provided with thermal insulation and/or heating elements to more completely surround a load space and minimize heat losses.

Many other modifications and variations will be apparent to those skilled in the art. It is therefore to be understood that within the scope of the appended claims, the invention may be practiced otherwise than as specifically described.

What is claimed is:

1. A vacuum furnace comprising:

a vacuum vessel having a shell;

means for evacuating the vacuum vessel;

means for supporting a load in a load space within the vacuum vessel;

a hot zone comprising heating elements surrounding at least a portion of the load space;

a cooling gas plenum surrounding at least a portion of the hot zone;

means for retracting the heating elements of the hot zone from around the load space to a location within the vacuum vessel while the heating elements are hot for minimizing heat transfer between the hot zone and the load space; and means for circulating cooling gas from the gas plenum toward the load space.

2. A vacuum furnace as recited in claim 1 wherein the hot zone comprises:

a frame;

thermal insulation mounted on the frame;

electrical heating elements mounted on the frame; and means on the frame for guiding retraction of the hot zone.

3. A vacuum furnace comprising:

a vacuum vessel;

means for evacuating the vacuum vessel;

a hot zone within the vacuum vessel;

means for supporting a load in a load space within the hot zone;

a cooling gas plenum surrounding at least a portion of the hot zone;

means for retracting the hot zone from between the load space and the plenum; and means for circulating cooling gas from the gas plenum toward the load space comprising a plurality of gas ejection nozzles directed toward the hot zone when the hot zone is between the load space and the plenum, and directed toward the load space when the hot zone is retracted.

4. A vacuum furnace as recited in claim 3 wherein the means for circulating cooling gas further comprises an external heat exchanger and blower for withdrawing cooling gas from the furnace shell and a post cooler and cooling gas inlet line for introducing cooling gas into the plenum.

5. A vacuum furnace as recited in claim 4 wherein the means for retracting the hot zone places the hot zone in a cooling location adjacent to the location where gas is withdrawn from the shell to the heat exchanger and blower.

6. A vacuum furnace as recited in claim 1 wherein the means for retracting the hot zone comprises a rack on the hot zone and a rotatable pinion engaging the rack.

7. A vacuum furnace as recited in claim 1 further comprising power feedthrough ports through a wall of the vacuum vessel and flexible electrical connectors between the ports and hot zone.

8. A vacuum furnace as recited in claim 1 wherein the means for retracting the hot zone moves the hot zone horizontally.

9. A vacuum furnace as recited in claim 1 wherein the means for retracting the hot zone moves the hot zone upwardly.

10. A vacuum furnace as recited in claim 1 further comprising means for introducing cooling gas through a wall of the vacuum vessel into the gas plenum and means for withdrawing gas through a wall of the vacuum vessel remote from the load space.

11. A vacuum furnace as recited in claim 10 wherein the means for withdrawing gas comprises a return line adjacent to the hot zone when the hot zone is retracted from the load space.

12. A vacuum furnace comprising:

a vacuum vessel;

means for evacuating the vacuum vessel;

a hot zone within the vacuum vessel;

means for supporting a load in a load space within the hot zone;

a cooling gas plenum surrounding at least a portion of the hot zone;

means for retracting the hot zone from between the load space and the plenum;

a gate selectively movable into a position between the load space and the hot zone when the hot zone is retracted from the load space; and means for circulating cooling gas from the gas plenum toward the load space.

13. A vacuum furnace as recited in claim 12 comprising means for introducing cooling gas on a load space face of the gate and withdrawing gas from the face of the gate opposite to the load space face.

14. A vacuum furnace as recited in claim 1 wherein the vacuum vessel has sufficient strength for withstanding superatmospheric pressure.

15. A vacuum furnace as recited in claim 1 wherein the vacuum vessel has sufficient strength for withstanding internal pressure up to two atmospheres absolute.

16. A vacuum furnace comprising:

a vacuum vessel with a hot zone having heating elements in a heating location within the vacuum vessel;

means for evacuating the vacuum vessel;

means for supporting a load in the hot zone in the heating location of the vacuum vessel;

means for ejecting cooling gas toward the load; and means for retracting the heating elements from the load to a cooling location within the vacuum vessel and remote from the load before ejecting cooling gas.

17. A vacuum furnace as recited in claim 16 wherein the means for ejecting cooling gas comprises a gas blower, a cooling plenum surrounding at least a portion of the hot zone in the heating location, and means for circulating cooling gas therebetween.

18. A vacuum furnace as recited in claim 16 wherein the vacuum vessel has sufficient strength for withstanding superatmospheric pressure.

19. A vacuum furnace as recited in claim 16 wherein the vacuum vessel has sufficient strength for withstanding internal pressure up to two atmospheres absolute.

20. A vacuum furnace as recited in claim 16 wherein the hot zone comprises heater elements and thermal insulation that are movable between the heating location within the vacuum vessel and the cooling location within the vacuum vessel.

21. A vacuum furnace as recited in claim 16 wherein the heating and cooling locations are side by side.

22. A vacuum furnace as recited in claim 21 wherein the means for retracting the hot zone comprises a plurality of wheels in tracks and a rack and pinion mechanism.

23. A vacuum furnace as recited in claim 16 wherein the cooling location is above the heating location.

24. A vacuum furnace comprising:

a vacuum vessel with a hot zone having heating elements in a heating location within the vacuum vessel;

means for evacuating the vacuum vessel;

means for supporting a load in the hot zone in the heating location of the vacuum vessel;

means for ejecting cooling gas toward the load;

means for retracting the heating elements from the load to a cooling location within the vacuum vessel before ejecting cooling gas; and means for placing thermal insulating material between the heating and cooling locations.

25. A vacuum furnace as recited in claim 24 wherein the means for placing insulating material between the heating and cooling locations within the vacuum vessel comprises a movable gate.

26. A vacuum furnace as recited in claim 16 further comprising a gate selectively movable into a position between the heating location and the cooling location.

27. A vacuum furnace as recited in claim 26 further comprising means for moving the gate vertically.

* * * * *